US009533698B2

(12) United States Patent
Warta et al.

(10) Patent No.: US 9,533,698 B2
(45) Date of Patent: Jan. 3, 2017

(54) RAILWAY MONITORING SYSTEM

(71) Applicants: Bartlett & West, Inc., Topeka, KS (US); R.J. Corman, Railroad Group, LLC, Nicholasville, KY (US)

(72) Inventors: Keith Warta, Topeka, KS (US); Doug Morrison, Lawrence, KS (US); Chris Cobb, Shawnee, KS (US); Korey Colyer, Nicholasville, KY (US); Craig King, Lexington, KY (US); Mike Wilson, Danville, KY (US)

(73) Assignees: Bartlett & West, Inc., Topeka, KS (US); R.J. Corman, Railroad Group, LLC, Nicholasville, KY (US)

( * ) Notice: Subject to any disclaimer, the term of this patent is extended or adjusted under 35 U.S.C. 154(b) by 360 days.

(21) Appl. No.: 14/495,357

(22) Filed: Sep. 24, 2014

(65) Prior Publication Data

US 2016/0082991 A1 Mar. 24, 2016

(51) Int. Cl.

| | |
|---|---|
| ***B61L 23/00*** | (2006.01) |
| ***B61L 23/04*** | (2006.01) |
| ***B61L 25/02*** | (2006.01) |
| ***B61L 27/00*** | (2006.01) |

(52) U.S. Cl.

CPC ..... *B61L 23/042* (2013.01); *B61L 25/021* (2013.01); *B61L 25/025* (2013.01); *B61L 27/0088* (2013.01); *B61L 2205/04* (2013.01)

(58) Field of Classification Search

CPC ..... B61L 23/04; B61L 23/042; B61L 25/00; B61L 25/021; B61L 25/02; B61L 25/023; B61L 25/025; B61L 25/026; B61L 25/028; B61L 27/0088; B61L 27/0083; B61L 27/0094; B61L 1/20

See application file for complete search history.

(56) References Cited

U.S. PATENT DOCUMENTS

| | | | | |
|---|---|---|---|---|
| 2001/0022332 | A1* | 9/2001 | Harland | B61L 25/021 246/122 R |
| 2006/0118678 | A1* | 6/2006 | Wells, II | B61L 23/00 246/121 |
| 2006/0119102 | A1* | 6/2006 | Hershey | H02N 1/08 290/1 R |
| 2008/0019701 | A1* | 1/2008 | Tam | B61L 1/166 398/141 |
| 2011/0309204 | A1* | 12/2011 | Bohlmann | B61L 1/188 246/122 R |
| 2014/0168630 | A1* | 6/2014 | Iida | G01S 17/936 356/3 |
| 2016/0082991 | A1* | 3/2016 | Warta | B61L 23/042 246/167 R |

* cited by examiner

*Primary Examiner* — Jason C Smith
(74) *Attorney, Agent, or Firm* — Hovey Williams LLP

(57) ABSTRACT

A railway monitoring system for detecting degradations, anomalies, changes, and other states of the railway that may indicate an increased probability of derailment, the need for maintenance, or the impedance of railway operation. The railway monitoring system broadly includes a sensor, a data storage component, a data collection and processing component, and a location positioning component. The sensor and other equipment are mounted in a specially designed or modified rail car and cooperatively collect data representative of railway conditions or states and detect changes in the conditions or states by comparing the collected data to previously collected data points.

20 Claims, 3 Drawing Sheets

RAILWAY MONITORING SYSTEM

BACKGROUND

The present invention relates to railway monitoring systems.

Railway monitoring systems monitor degradation of train tracks and other railway assets and detect the presence of impedances of rail rights-of-way. These systems are often designed to be operated at stationary positions along the railway or onboard rail-modified vehicles and commercial equipment (e.g., "hi-rail" and "road rail" vehicles). Specially trained crews are required to operate the vehicles, perform visual inspections, take photographs, and operate stationary light detection and ranging (LiDAR) equipment for monitoring sections of the railway. As such, these systems are costly to operate, interrupt normal rail service, pose safety risks, and require significant analysis and/or data processing, which delays corrective action and maintenance.

Recently, automated rail monitoring systems that operate onboard moving trains on normal scheduled routes have been designed. These systems typically include specialized sensors mounted to the rail and communication equipment mounted on a rail car that can relay information via radio to a railway operator. These systems are cost-prohibitive due to the number of sensors required, the labor required in installing the sensors, and the maintenance required to keep the sensors in working condition. Thus, automated rail monitoring systems are only used on a small percentage of railways.

Photography based rail monitoring systems that do not require the installation of fixed sensors are available. However, the large amount of data required to transmit and store photographs is inefficient and requires substantial post-processing. This again delays corrective action and maintenance.

SUMMARY

The present invention solves the above-described problems and provides a distinct advance in the art of railway monitoring systems. More particularly, the present invention provides a railway monitoring system that detects degradations, anomalies, changes, and other states of a railway that may indicate an increased probability of derailment, the need for maintenance, and/or the impedance of railway operation.

An embodiment of the railway monitoring system broadly includes a sensor, a data storage component, a data collection and processing component, a location positioning component, and mounting structure for mounting these components to a railcar.

The sensor senses changes in the railway and surrounding areas as the rail car traverses the railway. The sensor may be a LiDAR scanner, RADAR detector, camera, video camera, heat sensor, or similar sensing device and may include an inertial measurement unit (IMU) and optical data transmission.

The data storage component includes computer memory for storing data representative of the information received from the sensor system.

The data collection and processing component receives signals from the sensor, converts the signals to useable data points, and stores the data points on the data storage component. The data collection and processing component also compares data points with corresponding previously-acquired data points and determines whether any differences between data point pairs indicate degradation or changes in the state of the railway and surrounding areas. The data collection and processing component includes processors, controllers, and other computer hardware for interpreting the signals, managing the data points, making comparisons between the data points, and performing other calculations.

The location positioning component generates location signals representative of the position of the sensor along the railway so that the data collection and processing component can index the data points according to their corresponding locations.

A rail car may be configured to house the sensor, data storage component, and data collection and processing component. In one embodiment, the rail car includes a portal extending laterally along the bottom of the rail car and up the sides of the rail car for allowing the sensor to sense the changes in the railway and surrounding areas.

In use, the railway monitoring system is connected to a train via the rail car without any special modifications to the train. As the rail car travels along the railway, the railway monitoring system detects degradations, deteriorations, anomalies, changes, and other states of the railway by generating a first data collection (i.e., a baseline dataset) via the sensor as the rail car travels along the railway a first time and generating a second data collection as the rail car travels along the railway a second time. Data points in the first and second data collections are stored on the data storage component as they are generated. The data collection and processing component compares data points in the first data collection with corresponding data points in the second data collection. The data collection and processing component determines whether the corresponding data points are different or outside of an accepted range (e.g., "exceptions"). If exceptions are found, an exception report or exception dataset is generated and/or transmitted to a remote computer or computer system for further computer or human analysis if necessary. The railway monitoring system can continue to monitor the railway by generating additional data collections during additional passes along the railway and comparing data points in the additional data collections against data points in the original baseline dataset or data points in new baseline datasets.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the present invention will be apparent from the following detailed description of the embodiments and the accompanying drawing figures.

BRIEF DESCRIPTION OF THE DRAWING FIGURES

Embodiments of the present invention are described in detail below with reference to the attached drawing figures, wherein.

Figure 1:
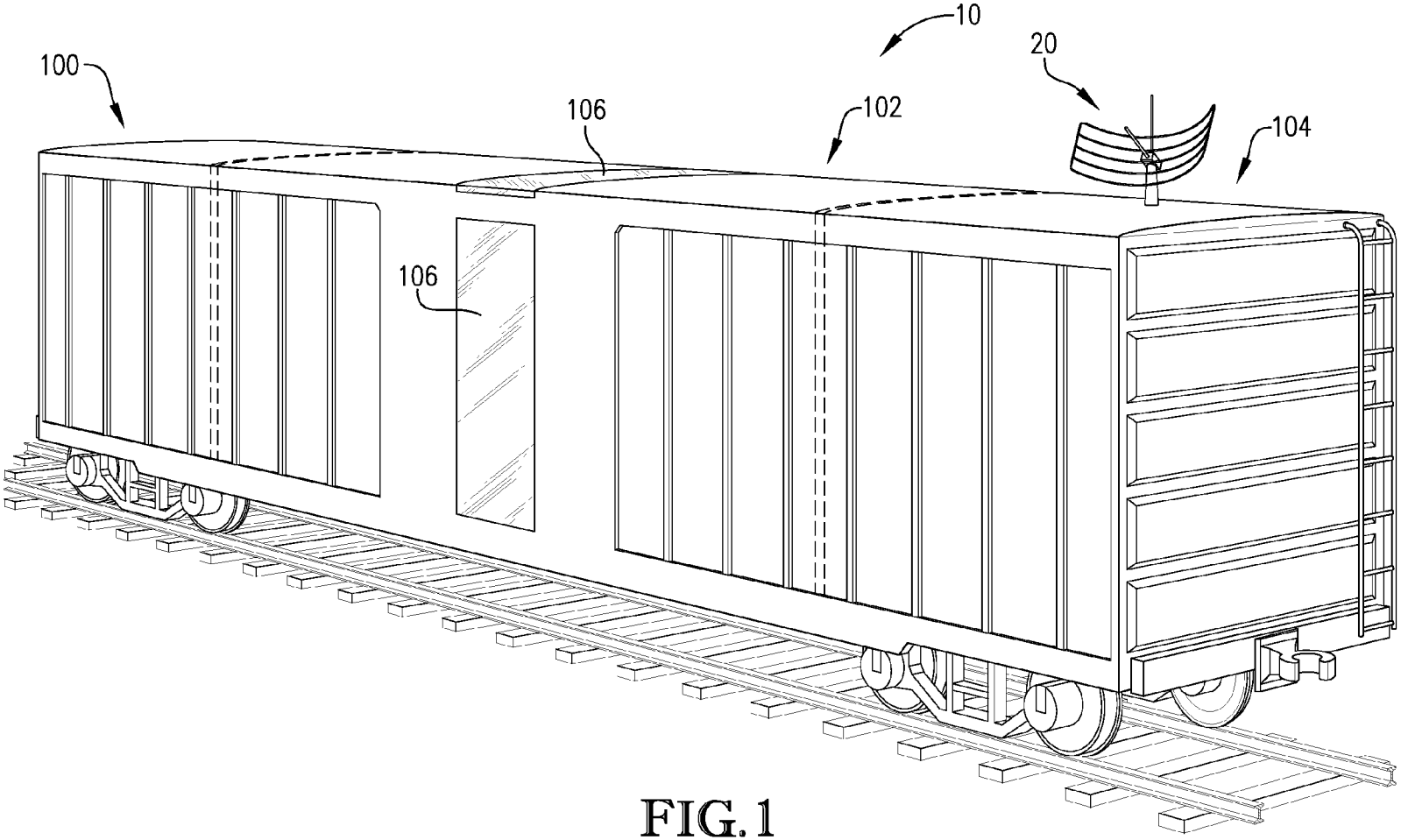
FIG. 1 is a perspective view of a rail car on which the railway monitoring system may be mounted.

The drawing figures do not limit the present invention to the specific embodiments disclosed and described herein.

The drawings are not necessarily to scale, emphasis instead being placed upon clearly illustrating the principles of the invention.

DETAILED DESCRIPTION OF THE EMBODIMENTS

The following detailed description of the invention references the accompanying drawings that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The following detailed description is, therefore, not to be taken in a limiting sense. The scope of the present invention is defined only by the appended claims, along with the full scope of equivalents to which such claims are entitled.

In this description, references to "one embodiment", "an embodiment", or "embodiments" mean that the feature or features being referred to are included in at least one embodiment of the technology. Separate references to "one embodiment", "an embodiment", or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the present technology can include a variety of combinations and/or integrations of the embodiments described herein.

Turning now to the drawing figures, a railway monitoring system 10 constructed in accordance with a preferred embodiment of the invention is illustrated. The railway monitoring system 10 broadly comprises a sensor 12, a data storage component 14, a data collection and processing component 16, a location positioning component 18, a transceiver 20, and mounting structure for housing and mounting these and other components to a rail car (such as rail car 100, described below).

The sensor 12 senses characteristics of the rail, the ground near the rail, the right-of-way around the rail, and structures above the rail and may be a LiDAR scanner, RADAR detector, camera, video camera, heat sensor, 3D imaging system, other similar sensing device, or a combination of sensing devices. The sensor 12 may passively sense light waves, sound waves, heat, or similar detectable phenomena or may actively transmit a laser beam, radio waves, sound waves, or similar signals and then sense their reflection as they bounce off of the ground, railway, and other structures. Data generated from the returning signals may be in the form of a characteristic of the returning signals such as intensity, resolution, or scattering, or may be the time elapsed between the time of signal transmission to the time of signal reception, as described below. The sensor 12 may include an inertial measurement unit (IMU) for making inertial data measurements as standalone data or to improve or corroborate other sensed data. The sensor 12 may transmit the data wirelessly or via optical or other wired means.

The data storage component 14 stores data collected by the data collection and processing component and includes a computer readable medium. In the context of this application, a "computer-readable medium" can be any non-transitory means that can store data for use by or in connection with the instruction execution system, apparatus, or device. The computer-readable medium can be, for example, but not limited to, an electronic, magnetic, optical, electromagnetic, infrared, or semi-conductor system, apparatus, or device. More specific, although not exclusive, examples of the computer-readable medium would include the following: an electrical connection having one or more wires, a portable computer diskette, a random access memory (RAM), a read-only memory (ROM), an erasable, programmable, read-only memory (EPROM or Flash memory), an optical fiber, and a portable compact disk read-only memory (CDROM). The data storage component includes sufficient space for initial route data storage, data sets in the process of analysis, and data output. The data storage component 14 may be partitioned for organizing data sets according to the railway, rail company, date, data set, and other parameters and may also include backup storage that is electrically isolated from the primary storage partition. The data storage component 14 may include portable and/or removable storage subcomponents for field personnel to collect and store full data sets.

The data collection and processing component 16 may implement aspects of the present invention with one or more computer programs stored in or on computer-readable medium residing on or accessible by the data collection and processing component 16. Each computer program preferably comprises an ordered listing of executable instructions for implementing logical functions in the data collection and processing component 16. Each computer program can be embodied in any non-transitory computer-readable medium for use by or in connection with an instruction execution system, apparatus, or device, such as a computer-based system, processor-containing system, or other system that can fetch the instructions from the instruction execution system, apparatus, or device, and execute the instructions. The data collection and processing component 16 includes a processing computer 22, a communications computer 24, a router 26, a virtualized wide area network (WAN) appliance 28, and a content optimization appliance 30. The data collection and processing component 16 may include one or more computers running Linux, Windows, Apple operating system, or any other suitable operating systems.

The processing computer 22 receives signals from the sensor 12, converts the signals into useable data points, and stores the data points on the data storage component 14. The processing computer 22 compares data points with corresponding previously-acquired data points in real time or at a later time and determines if there are any differences (e.g., "exceptions") between data point pairs that indicate degradation or changes in the state of the railway and surrounding areas. The processing computer 22 also generates an exception report and/or prepares a data set and transmits the report to a remote computer system 32 for further analysis.

The communications computer 24 ensures that data exceptions and/or exception reports that require immediate attention are timely and accurately transmitted to the remote computer system 32 or railway personnel. The communications computer 24 also allows remote access to railway personnel. It will be understood that the processing computer 22 and the communications computer 24 may perform the above tasks interchangeably as needed.

Figure 3:
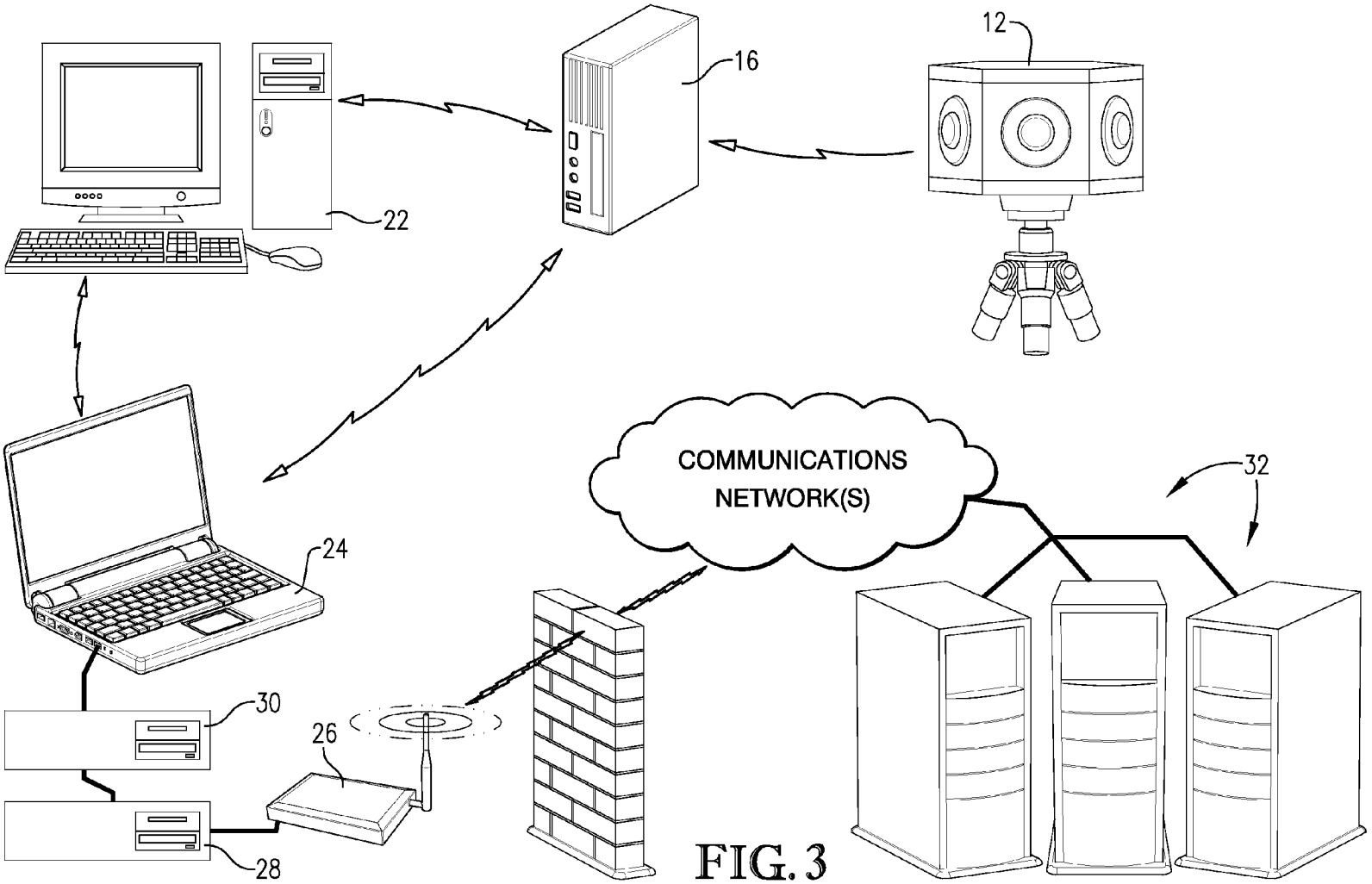
FIG. 3 is a schematic view of the railway monitoring system of FIG. 1.

The router 26 distributes and directs incoming and outgoing signal, data, and information transmissions between the railway monitoring system 10 and the remote computer system 32 and other networks, as shown in FIG. 3. The router 26 may be protected by a firewall or similar security software or hardware.

The virtualized wide area network (WAN) appliance 28 reduces application latency, conserves bandwidth, reduces network congestion, and performs other optimization processes within the local network between the computing devices of the railway monitoring system 10.

The content optimization appliance 30 also performs optimization processes for improving data-transfer efficiencies between the computing devices of the railway monitoring system 10.

The location positioning component 18 receives navigational signals from a GPS satellite for calculating a position of the railway monitoring system. The location positioning component 18 comprises an antenna or similar wireless signal receiver and/or transmitter and may include one or more processors, controllers, or other computer devices and memory for storing information accessed and/or generated by the data collection and processing component 16 or other computing devices.

The transceiver 20 transmits signals to and receives signals from the remote computer system 32 over a cellular network, satellite network, internet, and/or other networks.

The mounting structure supports the above-described components in or on a rail car and may include one or more shelves, beams, mounts, supports, brackets, panels, or any other suitable structure and hardware.

Figure 2:
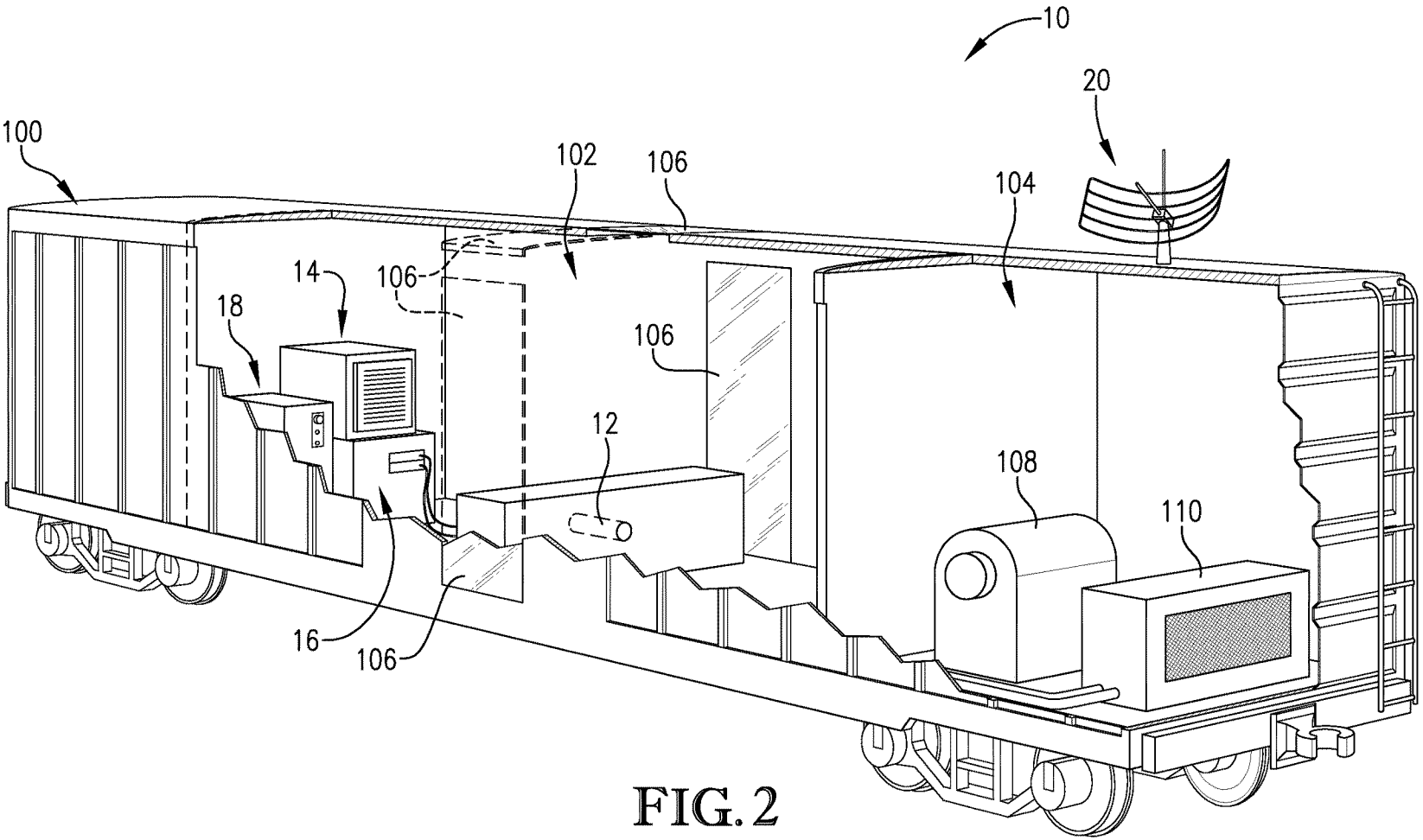
FIG. 2 is a cut-away perspective view of the rail car in FIG. 1 showing components of the railway monitoring system.

In one embodiment of the present invention, the above-described components are mounted on and/or housed in a specially designed or modified rail car 100 comprising a primary compartment 102 and at least one HVAC compartment 104, as shown in FIG. 2. The rail car 100 may be a box car, flat car, passenger car, caboose, engine, or any other suitable rail car.

The primary compartment 102 houses the sensor 12, data storage component 14, and data collection and processing component 16 and includes a portal 106.

The portal 106 provides a passageway for light waves, sound waves, or other waves transmitted and/or received by the sensor 12 to pass through the rail car 100 and is formed of acrylic, glass, or other transparent material. Alternatively, the portal may be an opening with no material. The portal 106 extends laterally along the bottom of the rail car 100 and up the sides of the rail car 100. The portal 106 may also extend laterally along the ceiling of the rail car 100. This allows the sensor 12 to sense characteristics of the rail, the ground near the rail, the right-of-way around the rail, and structures above the rail.

The at least one HVAC compartment 104 houses a power generator 108, an HVAC system 110, HVAC ductwork, and similar equipment.

The power generator 108 provides 208V, 110V, or similar source power to the sensor 12, data storage component 14, data collection and processing component 16, and HVAC system 110. Electrical power may instead be provided by an existing train power system. The power may be supplied through an uninterrupted power supply (UPS) device, a surge protector, fuse, or any other power regulating device.

The HVAC system 110 maintains a moderate temperature in the primary compartment 102 for optimal operation of the sensor 12, data storage component 14, and data collection and processing component 16.

In use, the railway monitoring system 10 is connected to a train via the specially designed rail car 100 without any special modifications to the train. The railway monitoring system 10 can be added to and removed from a train just like any other rail car and can be transferred between trains on different routes without the need to reset data storage or perform any calibrations. Alternatively, a shipping container or similar container may be configured to house the components of the railway monitoring system 10 and may be placed on a container car or other rail car. This allows the railway monitoring system 10 to very easily be incorporated into a train without disconnecting any of the cars. The railway monitoring system 10 begins to record data when the data collection and processing component 16 determines via the location positioning component 18, a speedometer, or other suitable device that the train has reached and/or is traveling at or above a minimum speed. The railway monitoring system 10 also will stop recording data when the data collection and processing component 16 determines that the train has fallen below and/or is traveling below the minimum speed. Alternatively, the railway monitoring system 10 may begin recording at a previously determined location at or near the beginning of a route as sensed by the location positioning component 18 and may stop recording at a previously determined location at or near the end of a route since the train is likely to stop or slow down below the minimum speed at least once along a route or between routes. This will prevent the occurrence of non-monitored zones.

The sensor 12 generates data by capturing light, heat, or other characteristics from the railway, ground, and right-of-way surrounding the railway, and nearby structures through the portal 106 in the rail car 100. For example, a camera or video camera can take pictures of railway features as the rail car 100 passes them. Alternatively, the sensor 12 may generate data by transmitting a laser light, radio wave, or similar signal towards the features and receiving any portion of the signal that reflects off of the features towards the sensor 12. For example, the sensor 12 may emit a collimated laser beam towards the rail. The laser beam will bounce off of the rail and at least partially reflect back to the sensor 12. The data generated may be the percentage of laser light that reflects to the sensor 12, the intensity of the reflection, the angle or position of the reflection, the "vibration" of the reflection, the time lapse between the time of signal transmission and the time of signal reception, and other similar characteristics of the reflection. The sensor 12 may emit signals nearly continuously so as to generate a nearly continuous data set or the sensor 12 may emit signals at spaced intervals. The sensor 12 then transmits the signals to the data collection and processing component 16 for storage and/or processing.

The railway monitoring system 10 collects data as the rail car 100 travels along the route for a first time. The data collection and processing component 16 indexes data points with the location of the sensor 12 as determined or sensed by the location positioning component 18. The data collection and processing component 16 also indexes the data collected on this first trip as baseline data, or a baseline data set, and does not perform any data comparisons because there is only one data set at this time. The data collection and processing component 16 stores the baseline data set and its indexes on the data storage component. The railway monitoring system 10 collects data as the rail car 100 travels along the route for a second time and indexes this data with location information as determined or sensed by the location positioning component 18. The data collection and processing component 16 stores the second data set and its indexes in the data storage component 14. The data collection and processing component 16 then retrieves the baseline data set and the second data set and compares data points from the baseline data set with corresponding data points from the second data set in real time or at a later time. That is, data points from the two data sets having the same location index are compared because they were collected at the same location. The data points are compared in terms of a difference between the measured output of one data point and the measured output of the corresponding data point. For example, two data points representing the amount of time elapsed between the time the signal was emitted and the time the signal was received are compared, resulting in a difference or zero difference between the amount of time lapsed for the first signal and the amount of time lapsed for the second signal. A difference of 0 represents that the condition of the railway or its surroundings has not changed. A non-zero difference (e.g., an "exception") represents that the condition of the railway has changed. The exception may be sufficient to signify a possible deterioration or degradation that should be reported or further analyzed. On the other hand, the exception may be within an acceptable error (i.e., an "insignificant difference") or similar margin due to a number of factors. For example, calibration and sensor resolution may result in insignificant exceptions. Weather, temperature, increased train loads, and similar factors may also result in exceptions that do not signify a deterioration or significant change. To overcome this, the exception may be compared against a predetermined threshold value. If the exception is less than the predetermined threshold value, it is considered insignificant and disregarded. If the exception is equal to or greater than the threshold value, it is retained. If the exception is equal to or higher than yet another threshold value representing a critical change, the data collection and processing component 16 may immediately transmit the exception and/or the corresponding data points to the remote computer system 32 via the transceiver 20 for timely analysis and/or immediate maintenance. Otherwise, the exception(s) is compiled in an exception report and transmitted to the remote computer system 32 via the transceiver 20 after the train has reached its destination, as described below.

The sensor 12 may collect additional data points and/or supplemental data when an exception is generated. For example, the sensor 12 may take more frequent readings, a camera may begin taking photographs, a video camera may begin taking video footage, or a 3D imaging system may begin mapping the rail system. The sensor 12 may stop collecting the additional data points and supplemental data when the data returns to normal. The additional data and supplemental data may prove to be valuable information during data analysis. This also prevents large amounts of unnecessary data from being collected and stored during operation.

The exception report may indicate the value or magnitude of the exception, the values of the corresponding data points, the index location of the corresponding data points, and may include the supplemental data. The exception report may be in the form of a graphical report, a printed data set, an image, or other similar media.

The data collection and processing component 16 may set the second data set as a new baseline data set and compare data points in the next data set against data points in the new baseline data set as the train travels the route for subsequent passes. This allows for any new change in condition of the railway to be monitored. The original baseline data set in this case may be erased from the data storage component 14 or overwritten by the new data. Alternatively, the data collection and processing component 16 may retain the original baseline data set and compare the data points in the next data set against data points in the original data set. This approach will result in essentially a measurement of absolute change in condition of the railway.

The above-described railway monitoring system 10 provides several advantages over conventional systems. For example, the railway monitoring system 10 does not require an onsite crew for operation. The railway monitoring system 10 also does not interrupt or delay normal train traffic and does not pose additional safety risks. The railway monitoring system 10 does not require post processing or significant analysis. The railway monitoring system 10 requires only one sensor and does not require the installation of equipment along the railway. The components of the railway monitoring system 10 are completely or substantially contained within the rail car 100 and kept in a climate controlled environment. This significantly reduces the amount of maintenance required to operate the system 10 and drastically improves its working life. The railway monitoring system 10 also minimizes the data storage required and the amount of wireless data transmission. This reduces the cost of operation and improves reliability.

Although the invention has been described with reference to the embodiments illustrated in the attached drawing figures, it is noted that equivalents may be employed and substitutions made herein without departing from the scope of the invention as recited in the claims.

Having thus described various embodiments of the invention, what is claimed as new and desired to be protected by Letters Patent includes the following:

1. A system for monitoring a condition of a railway, the system comprising:

a sensor positioned in or on a rail car for sensing states of features of the railway as the rail car traverses the railway at least a first time and a second time;

a data storage component; and a data collection and processing component configured to:

receive from the sensor a first set of signals representative of the states of the features of the railway as the rail car traverses the railway the first time and store the first set of signals as a first set of data points on the data storage component;

receive from the sensor a second set of signals representative of the states of the features of the railway as the rail car traverses the railway the second time and store the second set of signals as a second set of data points on the data storage component;

retrieve the first and second sets of data points from the data storage component;

compare the first set of data points with the second set of data points for identifying any differences between data points in the first set of data points and corresponding data points in the second set of data points; and generate at least one signal representative of the identified differences, the differences being representative of a change in the state of one or more features of the railway.

2. The system of claim 1, further comprising a location determining component configured to generate location signals representative of a geographic location of the sensor along the railway, the data collection and processing component being configured to index each data point in the first and second data sets with the location of the sensor from which the data point was taken.

3. The system of claim 2, wherein the location determining component is a global navigational satellite system (GNSS) receiver.

4. The system of claim 1, further comprising a speed sensor configured to detect a speed of the rail car, the data collection and processing component being configured to compile data points when the rail car is traveling above a miniminum speed as detected by the speed sensor and to not compile data points when the rail car is traveling below the minimum speed.

5. The system of claim 1, further comprising a transceiver for wirelessly communicating with remote server computer systems via cellular and satellite networks.

6. The system of claim 1, wherein the sensor is an inertial measurement unit.

7. The system of claim 1, wherein the sensor is a high speed LiDAR scanner.

8. The system of claim 7, wherein the data collection and processing component is configured to create a three-dimensional model of a section of the railway where a change of the state of a feature of the railway is detected.

9. The system of claim 1, wherein the data collection and processing component is configured to collect additional data of a section of the railway where a change of the state of a feature of the railway is detected.

10. The system of claim 9, further comprising a camera configured to take a photograph of a section of the railway where a change of the state of a feature of the railway is detected.

11. The system of claim 9, further comprising a video camera configured to take a video of a section of the railway where a change of the state of a feature of the railway is detected.

12. The system of claim 1, wherein the data collection and processing component is further configured to generate a report when a change of the state of a feature of the railway is detected.

13. A system for monitoring a condition of a railway, the system comprising:

a rail car;

a sensor positioned in or on the rail car for sensing states of features of the railway as the rail car traverses the railway at least a first time and a second time;

a data storage component; and a data collection and processing component configured to:

receive from the sensor a first set of signals representative of the states of the features of the railway as the rail car traverses the railway the first time and store the first set of signals as a first set of data points on the data storage component;

receive from the sensor a second set of signals representative of the states of the features of the railway as the rail car traverses the railway the second time and store the second set of signals as a second set of data points on the data storage component;

retrieve the first and second sets of data points from the data storage component;

compare the first set of data points with the second set of data points for identifying any differences between data points in the first set of data points and corresponding data points in the second set of data points; and generate at least one signal representative of the identified differences, the differences being representative of a change in the state of one or more features of the railway.

14. The system of claim 13, wherein the rail car includes a portal, the sensor being configured to take readings through the portal.

15. The system of claim 14, wherein the portal is positioned midway between the front and back of the rail car.

16. The system of claim 14, wherein the portal extends laterally along the bottom of the rail car and extends at least partially up each side of the rail car.

17. The system of claim 16, wherein the sensor is positioned above a bottom portion of the portal and between side sections of the portal for increasing a detection range of the sensor.

18. The system of claim 16, further comprising a second portal extending laterally along the top of the rail car.

19. The system of claim 13, wherein the rail car is divided into a first compartment configured to hold the sensor, the data storage component, the data collection and processing component, and the transceiver, and a second compartment configured to hold a power source for powering the sensor, the data storage component, and the data collection and processing component and additional heating and cooling equipment for maintaining a temperature of the first compartment within a predetermined temperature range.

20. A system for monitoring a condition of a railway, the system comprising:

a rail car having a portal positioned midway between the front and back of the rail car, a bottom portion of the portal extending laterally along the bottom of the rail car and sides of the portal extending at least partially up each side of the rail car;

a LiDAR sensor positioned above the bottom portion of the portal and between the side sections of the portal for sensing states of features of the railway and surrounding areas as the rail car traverses the railway at least a first time and a second time;

a data storage component;

a data collection and processing component configured to:

receive from the LiDAR sensor a first set of signals representative of the states of the features of the railway as the rail car traverses the railway the first time and store the first set of signals as a first set of data points on the data storage component;

receive from the LiDAR sensor a second set of signals representative of the states of the features of the railway as the rail car traverses the railway the second time and store the second set of signals as a second set of data points on the data storage component;

retrieve the first and second sets of data points from the data storage component;

compare the first set of data points with the second set of data points for identifying any differences between data points in the first set of data points and corresponding data points in the second set of data points; and generate at least one signal representative of the identified differences, the differences being representative of a change in the state of one or more features of the railway;

a location positioning component configured to generate location signals representative of the position of the sensor along the railway, the data collection and processing component being configured to index each data point in the first and second data sets with the position of the sensor from which the data point was taken, the location positioning component further being configured to detect a speed of the rail car, the data collection and processing component being configured to compile data points when the rail car is traveling above a miniminum speed as detected by the speed sensor and to not compile data points when the rail car is traveling below the minimum speed;

a transceiver connected to the data collection and processing component for wirelessly transmitting a signal representative of the change to a remote server computer system; and a power source for providing power to the sensor, the data storage component, and the data collection and processing component.

* * * * *